US008434652B2

(12) United States Patent
Rushe et al.

(10) Patent No.: US 8,434,652 B2
(45) Date of Patent: May 7, 2013

(54) CAP AND NOZZLE ASSEMBLY FOR TUBES, CONTAINERS AND PACKS CLOSED BY THE ASSEMBLY

(75) Inventors: Peter C. Rushe, Dusseldorf (DE); Patrick Kealy, Loughboy (IE)

(73) Assignee: Henkle Ireland Limited, Monheim (DE)

( * ) Notice: Subject to any disclaimer, the term of this patent is extended or adjusted under 35 U.S.C. 154(b) by 1065 days.

(21) Appl. No.: 12/044,571

(22) Filed: Mar. 7, 2008

(65) Prior Publication Data

US 2009/0224008 A1 Sep. 10, 2009

(51) Int. Cl.
*B65D 47/00* (2006.01)

(52) U.S. Cl.
USPC ..... 222/549; 222/546; 222/562; 222/563; 215/321

(58) Field of Classification Search ..... 222/153.09, 222/153.01, 562, 563, 549, 525, 546, 519, 222/520, 522; D9/453; 215/321, 295, 332, 215/216, 331; 220/4.21
See application file for complete search history.

(56) References Cited

U.S. PATENT DOCUMENTS 2,248,011 A * 7/1941 Neuschaefer ..... 401/6
3,604,585 A * 9/1971 Towns ..... 215/235
4,270,664 A * 6/1981 Buono ..... 215/216
4,281,778 A * 8/1981 Stull ..... 222/153.09
4,313,686 A * 2/1982 Proffer ..... 401/127
4,653,676 A * 3/1987 Stull ..... 222/566
D296,081 S * 6/1988 Kuboshima ..... D9/443
4,964,539 A * 10/1990 Mueller ..... 222/94

(Continued)

FOREIGN PATENT DOCUMENTS

DE 20 2006 010719 U1 9/2006
FR 743 189 A 3/1933

(Continued)

OTHER PUBLICATIONS

International Search Report issued against International Patent Application No. PCT/EP2009/052472 mailed on Jul. 9, 2009.

*Primary Examiner* — Kevin P Shaver
*Assistant Examiner* — Robert Nichols, II
(74) *Attorney, Agent, or Firm* — Steven C. Bauman; James E. Piotrowski

(57) ABSTRACT

A cap for overfitting a nozzle having an elongate nozzle body; the cap having an elongate cap body with a longitudinal axis, and an outside surface and an inside surface. The cap body has closed end and an open end, with an at least one sidewall. A housing of the cap has an open end. The cap is for receiving and overfitting the nozzle body of the nozzle. The cap has three elongate spaced apart wing portions each having a wing profile each forming part of the outside surface of the cap. Each wing runs from the mouth of the cap to the closed end thereof, and each contiguous with the next so that an exterior face of one wing portion together with an exterior face of an adjacent wing portion form one continuous concave surface between each wing portion and the adjacent one. The cap has a part-helical, or skewed profile, which gives a visual indication of the direction of removal of the cap from the nozzle. A nozzle has matching depressions, which come into register with the concave surfaces of the cap. The assembly of cap over nozzle is suitable as a closure for a container holding curable product such as adhesive. A locking ring may be provided on the tube for locking a nozzle to the tube.

19 Claims, 9 Drawing Sheets

U.S. PATENT DOCUMENTS

| | | | | |
|---|---|---|---|---|
| 5,160,057 | A * | 11/1992 | Fitjer | 215/44 |
| 5,379,927 | A * | 1/1995 | Montenieri et al. | 222/546 |
| 5,992,656 | A * | 11/1999 | Dujardin et al. | 215/44 |
| 6,053,375 | A * | 4/2000 | Schwartz et al. | 222/567 |
| D443,206 | S * | 6/2001 | Weber | D9/520 |
| 6,796,462 | B2 * | 9/2004 | Hudson et al. | 222/147 |
| 2002/0166834 | A1 * | 11/2002 | Branson et al. | 215/216 |
| 2005/0011911 | A1 * | 1/2005 | Vaughan | 222/182 |
| 2006/0273063 | A1 * | 12/2006 | Borger | 215/331 |
| 2007/0257069 | A1 * | 11/2007 | Gibson et al. | 222/563 |

FOREIGN PATENT DOCUMENTS

| | | | |
|---|---|---|---|
| GB | 992 876 | A | 5/1965 |
| NL | 6 908 236 | A | 2/1970 |
| WO | WO 01/56894 | | 8/2001 |
| WO | WO 2005/075312 | | 8/2005 |

* cited by examiner

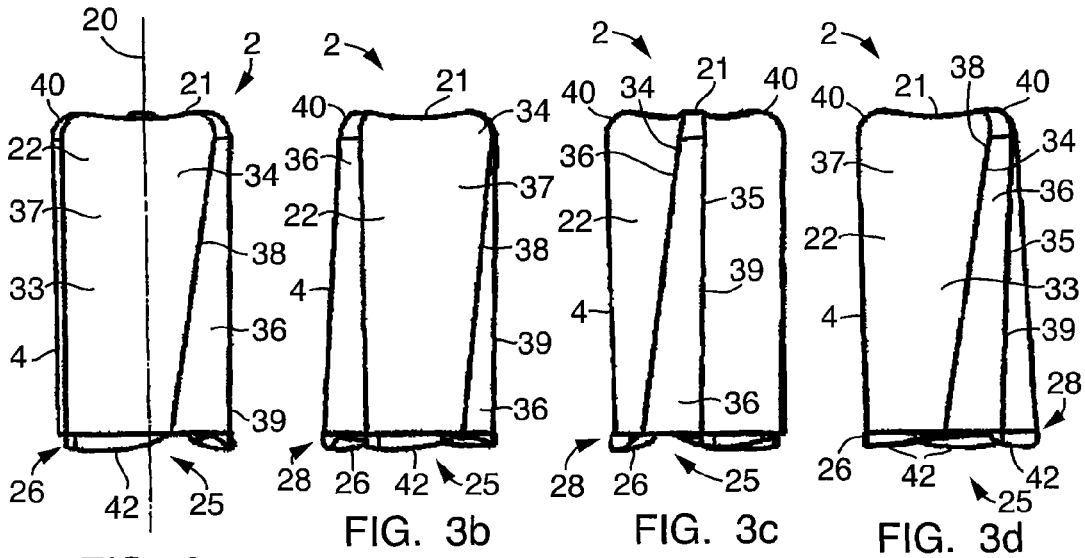
FIG. 3a
FIG. 3b
FIG. 3c
FIG. 3d
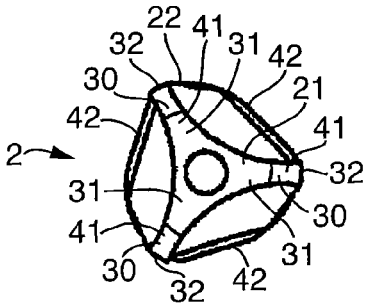
FIG. 3e
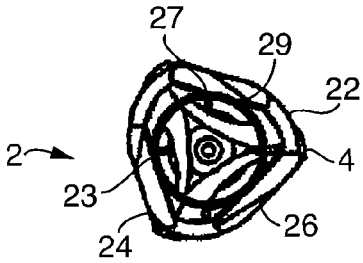
FIG. 3f
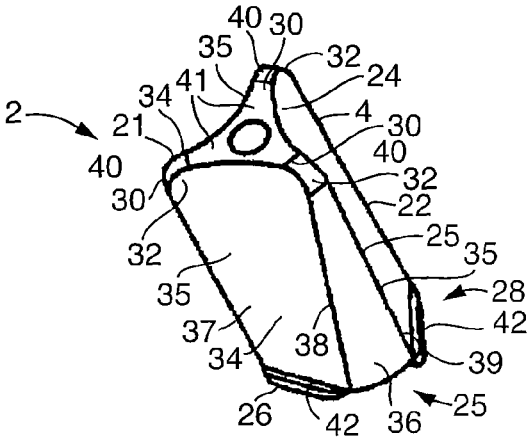
FIG. 3g

CAP AND NOZZLE ASSEMBLY FOR TUBES, CONTAINERS AND PACKS CLOSED BY THE ASSEMBLY

BACKGROUND

1. Field

The present disclosure relates to caps and nozzles, in particular those suitable for use to close a container. The disclosure also relates to an assembly comprising the nozzle or cap and to a container fitted with the nozzle and/or cap. Of particular interest, are those caps and nozzles that are used to close a container that holds a curable product, for example adhesives, sealants and coatings. The nozzle may be of the type that is for attachment to a container from which it is desired to dispense the contents. Alternatively the nozzle may be integrally formed as part of the container. Containers closed by the assembly, in particular packs having a container closed by the assembly and having curable product within the container also form part of the present disclosure. Of particular interest are containers such as aluminum tubes that may be closed with such an arrangement. The various aspects are of interest in particular for curable products such as instant adhesives for example cyanoacrylate-based materials.

2. Brief Description of Related Technology

Those skilled in the art of caps/nozzles will know that there are many types of cap/nozzle assembly which have been devised for different end uses. International Patent Application no. PCT/IE2005/000010 describes one type of a cap and nozzle assembly which is suitable for use with a curable product. This cap and nozzle assembly is engineered to create high shear forces along the longitudinal axis of the cap/nozzle assembly. The shear forces help overcome any bonding between the cap and the nozzle caused by cured curable product.

A cap of the type having gripping wings thereon, for manual gripping thereof, is described in International Patent Publication No. WO 01/56894. The cap fits over a brush type applicator. In the embodiments shown, the cap (see for example FIGS. 4 and 14 of WO 01/56894) acts as an overfitting cap to an applicator (not to a nozzle). Furthermore, the cap does not provide a visual indication to a user of the direction of removal of the cap.

It is desirable to provide a cap/nozzle arrangement which will give a visual indication to a user of the correct "on" position of the cap on the nozzle, and additionally a visual indication of the direction for removal, for example direction of twisting, of the cap to remove it from the nozzle. It is further desirable to provide an ergonomically designed cap that maximises the translation of the force exerted on the cap by the user into a twisting force to remove the cap from the nozzle.

A further difficulty is that in certain instances where a dispensing nozzle/cap assembly is provided the nozzle may be removed with the cap. For example where cured product fouls the interengaging mechanism between the cap and the nozzle the two may become difficult to separate. In such an instance use of increased force may remove the cap and the nozzle together from a tube holding product. This is obviously undesirable, particularly in the case of aluminum tubes and/or where the material being dispensed is an instant adhesive such as a cyanoacrylate. It is of interest to avoid this potential problem where possible.

SUMMARY

In one aspect a cap/nozzle arrangement is provided which functions in a manner which is particularly intuitive to a user.

In a further aspect a locking arrangement is provided for locking a cap/nozzle arrangement on a tube. This avoids inadvertent removal of a dispensing nozzle when removing a cap. The various aspects may be used to (store and) dispense industrial or consumer products for instance curable products such as adhesive products.

BRIEF DESCRIPTION OF THE DRAWINGS

FIG. 2 shows various views of the cap/nozzle assembly of FIG. 1 as follows:

FIG. 3 shows various views of one embodiment of a cap, which forms part of the assembly of FIG. 1 as follows:

FIG. 3*a* is a front elevational view thereof;

FIG. 3*b* is a side elevational view thereof;

FIG. 3*c* is a rear elevational view thereof;

FIG. 3*d* is a side elevational view thereof from the other side thereof;

FIG. 3*e* is a top plan view thereof;

FIG. 3*f* is an underneath view thereof;

FIG. 3*g* is a perspective view thereof from a top and side thereof;

FIG. 4 shows various views of one embodiment of a nozzle, which forms part of the assembly of FIG. 1 as follows:

FIG. 5 shows various views of another embodiment of the cap/nozzle assembly as follows:

FIG. 6 shows various views of an embodiment of the cap/nozzle assembly and parts as follows:

DETAILED DESCRIPTION

Figure 1:
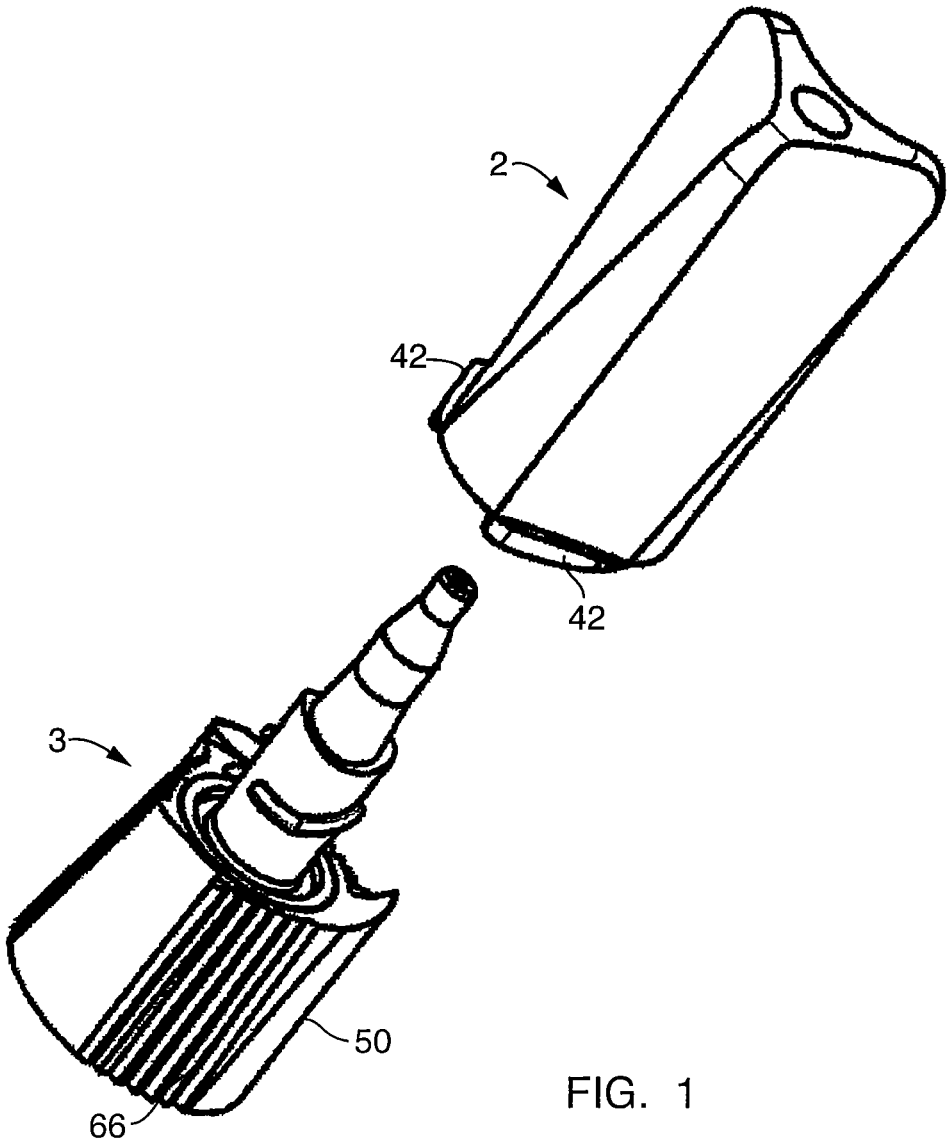
FIG. 1 shows an exploded side perspective view of one embodiment of a cap and nozzle which are aligned for mating thereof.

With reference to the embodiment shown in FIGS. 3*a-g*, a cap 2 forms part of a cap/nozzle assembly 1. The cap 2 is for overfitting a nozzle 3. The cap 2 has an elongate cap body 4 with a longitudinal axis 20. The cap 2 has a first closed end 21 and an at least one side wall 22 which in the embodiment is a continuous side wall forming a continuous or endless wall, integrally formed with and depending from the closed end 21. The sidewall 22 is in the embodiment one wall that loops around to join with itself. It may be substantially circular as shown but also other desired shapes. As shown best in FIG. 3*f*, the sidewall 22 has an inside surface 23 and an outside surface 24. The sidewall 22 forms a housing 25 defined (bounded by) the inside surface 23 of the cap body 4. The sidewall 22 also forms an open end 26 at the base end 28 of the cap body 4 with a mouth 27 between the inside 23 and outside 24 surfaces. The mouth 27 is effectively formed by the terminal face of the wall 22.

The housing 25 is for receiving and overfitting at least a part of an elongate nozzle body of the nozzle 3 as shown in FIG. 2 and as will be described below in more detail. Furthermore engaging formations in the form of screw threads 29 are provided on the cap and are for inter-engaging with (reciprocal) co-operating engaging formations in the form of screw threads on the nozzle 3 as will be described in more detail below. The inter-engagement of the inter-engaging formations will, in the embodiment, removably hold the cap 2 in a position partially over-fitting the nozzle 3 as shown in FIG. 2.

With reference to FIG. 3, the cap 2 has a plurality of elongate spaced apart wing portions each labelled 30. It is desirable that there are at least three wing portions, although more or less wing portions may be employed. Use of three wing portions provides the cap with a particularly ergonomic profile well suited to manipulation by a user's thumb, index and middle fingers. Desirably, each wing portion is equiangularly spaced apart from each adjacent wing portion.

Each wing portion 30 has a wing profile with an inner part or wing stem 31 best seen from FIG. 3*e* proximate the longitudinal axis 20 of the cap 2. In the embodiment shown, and as is generally desirable, the inner parts 31 meet in a contiguous fashion. The wing portions 30 each have an outer part 32 connected to (integrally formed with) the respective inner part 31. The outer part 32 is spaced radially outwardly from the inner part 31.

It will be appreciated that the term "inner part" is used to describe that part of the wing portion distal to the outer part and in general that part which extends to meet and join the other wing portions. In general the inner parts will extend about the longitudinal axis 20 of the cap 2. As with the other parts of the wing portions the inner part extends along the entire length of the wing portion.

An intermediate wing part 33 (shown best if FIG. 3*a*) is integrally formed with the inner part 31 and the outer part 32 to form the wing profile. The wing profile thus has two opposing faces 34, 35 which form part of the outside surface 24 of the cap body 4. These may also be described as the leading face 35 and the trailing face 34. The wing portions 30 have an outer terminal face 36, which forms the outer edge of the wing portions 30. It will be noted that each wing portion 30 advantageously has the same wing profile as the next.

In addition in the embodiment each wing portion 30 is contiguous with the adjacent ones and therefore the exterior shape (and profile) of the cap is defined entirely by the contiguous shape created by the wing portions. While it will be appreciated that different shapes of cap can be provided by employing different numbers and shapes of wing portions, the contiguous nature of the wing portions forming the cap should not be lost.

In the embodiment shown the cap 2 is a screw-on cap so it is desirable that the mouth 27 is circular in shape. In turn, the wing portions 30, in particular the outer ends thereof (as defined by the terminal faces 36 thereof), also are arranged so that each, at any given point thereon (running from the mouth 27 of the cap to the closed end 21 thereof), substantially lie along a circle of a given radius drawn about the longitudinal axis 20 of the cap.

It will be noted that each wing portion 30 runs from the base end 28 of the cap to the closed end 21. As stated above each wing portion 30 is contiguous with the next so that an exterior face (trailing face) 34 of one wing portion together with an exterior face (leading face) 35 of an adjacent wing portion 30 form one continuous somewhat concave surface 37. The concave surfaces 37 run between the terminal faces 36 on the sides of each wing portion 30. The concave surfaces 37 can also be described as running from respective sides of each wing portion 30 to respective sides of adjacent wing portions.

The wing portions 30 are given a part helical, a skewed or twisted appearance as will be explained in more detail below. The wing portions 30 are profiled in this way to give a visual indication to a user of the direction of twisting for removal of the cap.

In addition, the concave surfaces of the cap are helically skewed in the direction required to twist the cap to remove the cap from the nozzle. Normally, to remove a cylindrical cap from a cylindrical nozzle, a user will grip the cap with the thumb and fingers. With standard cylindrical or conical shaped caps, or even caps with lobes or ridges set perpendicular to the longitudinal axis of the cap, the user must exert forces in two directions simultaneously; the first force is a gripping force in the direction from the exterior of the cap towards the centre of the cap. The second force is a twisting, circular force, in the direction required to remove the cap from the nozzle. In circumstances where the cap is closed tightly on the nozzle, for example, by being additionally bonded by excess or spilled adhesive, the user must exert a very strong gripping force with fingers and thumb and exert the twisting force by means of additional arm and wrist motion. This can prove uncomfortable for the user, and can require a combination of strength and dexterity beyond some users.

The present invention overcomes or ameliorates to an extent these drawbacks by means of a cap for reversibly closing over a nozzle comprising at least three wing portions helically pitched in the direction required to remove the cap from the nozzle. Preferably, the cap comprises helically pitched (skewed) concave surfaces between the wing portions. The advantage of this is that when a user's thumb, index and middle fingers engage with the concave surfaces in a gripping action the helical pitch (twist) naturally biases the gripping force generated by the user in the direction required to remove (unscrew) the cap from the nozzle.

In addition, the helically pitched concave surfaces provides greater comfort than would non-concave surface when the user generates a twisting force to remove the cap from the nozzle with fingers and thumb.

The terminal face 36 advantageously has a desired wedge shape. The wedge shape can be created by having one edge run substantially parallel to the longitudinal axis of the cap 2 while the other edge is angled thereto and converges toward the other edge in the direction from the base end 28 of the cap to the closed end 21 thereof. In the embodiment shown in the Figures, edge 39 runs substantially parallel to the longitudinal axis of the cap 2 while edge 38 is angled thereto and converges toward the edge 39 in the direction from the base end 28 of the cap to the closed end 21 thereof. The edges 38 and 39 are substantially straight edges, as the concave surfaces 37 run from the edges 38 and 39 the concavity of the surface increases (is more pronounced) toward edge 38 and also toward the (top) closed end of the cap 2. This contributes to the skewed or part-helical profile of the cap.

In one embodiment the wing portions 30 have a tapered profile which can be best seen from FIGS. 3*a-d* and 3*g*. In the Figures the outer terminal face 36 is defined between borders or edges 38 and 39 of faces 34 and 35 respectively (the common edge between each face 34 or 35 and the terminal face 36). In this embodiment the distance between the faces 34 and 35 decreases in a direction from the base end 28 toward the closed end 21. This outer terminal face 36 of each wing portion 30 with a desirable tapered profile. It will be appreciated that other terminal face profiles are possible.

As shown best in FIGS. 2*e*, 3*e*, 4*e*, 5*e* and 6*e*, each of the wing portions 30 is advantageously configured so that there are 3 concave surfaces of substantially the same profile. This gives the cap 2 an overall symmetry. It also gives the closed end 21 of the cap a tri-leg (or triskellion) or propeller type appearance—where the terminal top face 41 of each wing 30 is a substantially straight one.

A corner 40 between a terminal face 36 and a respective top face 41 of the top end 21 may be rounded for handling purposes and to avoid sharp edges.

With reference to FIG. 3, lips 42 (three of them) are provided about mouth 27 (each adjacent a respective concave surface 37). The lips 42 cam against an inclined shoulder 55 on the nozzle to provide a ramping twist-off effect as disclosed in corresponding International application no. PCT/IE2005/000010.

It will be appreciated that the cap 2 in this embodiment lies substantially within its own circumferential footprint. In particular it is to be noted that the wing portions 30, while they may flare out to a small extent toward the closed end 21 of the cap, are within the footprint of the base end of the cap.

Referring now to FIGS. 1 and 4 *a-g*, the (dispensing) nozzle 3 will be described in detail. The nozzle 3 engages with the cap 2 to form the assembly 1 of FIG. 2 *a-g*. In particular the dispensing nozzle 3 has and an elongate nozzle body 50 having a base portion 54 formed by sidewall 52. The nozzle 3 also has an upper portion 53 which may be of a reduced diameter relative to the base portion 54. In the embodiment the reduction in diameter between the upper portion 53 and the base portion is a stepwise reduction.

An inclined shoulder 55 on the nozzle body extends between the upper portion 53 and the base portion 54. It is against the shoulder 55 that the base end 28 of the cap 2 will abut to form the assembly of FIG. 2.

The nozzle 3 has a dispensing end 51 at the top end or tip thereof. An internal conduit 56 runs longitudinally from a base end 57 of the nozzle body 2 to the dispensing end 51 thereof. The conduit is for delivering product from the base end to the dispensing end 51. The conduit is typically centred about a longitudinal axis 64 of the nozzle 3. The base end 57 may be provided with interengaging formations to allow it to be attached to a container holding curable product. Alternatively the nozzle could be formed as an integral part of a container.

As can be seen from the drawings and FIGS. 4 *a-g* in particular, the nozzle comprises engaging formations 58, such as screw thread for inter-engaging with co-operating engaging formations (screw threads 29) on a cap. The inter-engaged formations hold the cap in a position over-fitting the nozzle as shown in FIG. 2.

The nozzle body 50 shown in FIG. 4 has three depressions 59 in the sidewall 52. Three island or intermediate portions 60 of the base portion 52 stand proud of the depressions 59 and each depression 59 is between two intermediate portions 60 and vice versa.

As best seen from FIGS. 4*a-d* and 4*g*, the outer face 61 of each intermediate portion 60 is defined between borders or edges 62 and 63 of each face 61 (the common edge between each and the depressions 59). Because the distance between the edges 62 and 63 decreases toward the shoulder 55 the face 61 of each intermediate portion 60 has a tapered profile which is desirable.

In the embodiment the tapered profile is such that the distance between the edges 62 and 63 decreases (on the base portion 62) in a direction from the lower intake end 57 toward the dispensing end 51, though it will be appreciated that other tapered profiles are possible. In particular each face 61 has a desired wedge shape. The wedge shape is created by having one edge run substantially parallel to the longitudinal axis 64 of the nozzle 3 while the other edge 63 is angled thereto and converges toward that edge in the direction from the lower intake end 57 toward the dispensing end 51.

In the embodiment edge 63 runs substantially parallel to a longitudinal axis 64 of the nozzle 3 while edge 62 is angled thereto and converges toward the edge 63 in the direction from the lower intake end 57 toward the dispensing end 51. The edges 62 and 63 are substantially straight edges.

The profile of the depressions 59 is concave running from the edge 62 and 63, and if desired (and as shown in the embodiment) the depression may increase toward edge 65 which is the edge between shoulder 55 and the base portion 54. This profile, as shown in the Figures, is arranged to come into register with the profile of the cap 2 when the cap is fitted to the nozzle. This arrangement gives the nozzle 3 an overall symmetry.

The wedge shape of faces 61 of the intermediate portion runs along the entire length of the base portion 54. The depression 59 has a series of parallel ribs 66 thereon. The ribs 66 are for ease of gripping etc.

The intake end 57 of the nozzle 3 may be provided with engaging means to allow it to be attached to a container such as an aluminum tube for holding a curable product such as an adhesive.

Figure 6A:
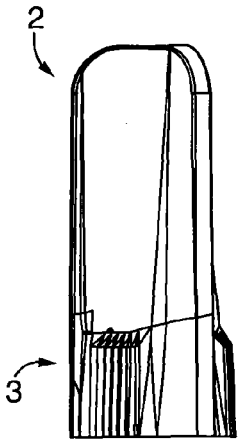
FIG. 6*a* is a front elevational view of the cap/nozzle assembly.
Figure 6B:
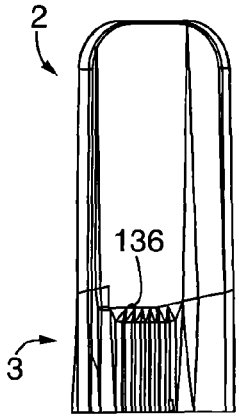
FIG. 6*b* is a side elevational view of the cap/nozzle assembly.
Figure 6C:
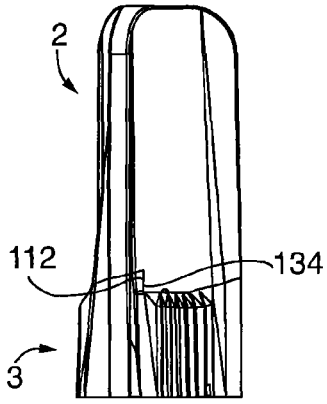
FIG. 6*c* is a rear elevational view of the cap/nozzle assembly.
Figure 6D:
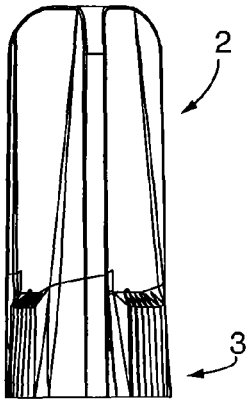
FIG. 6*d* is a side elevational view of the cap/nozzle assembly from the other side thereof.
Figure 6E:
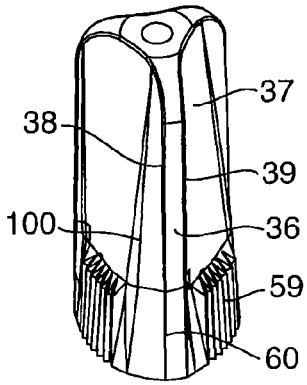
FIG. 6*e* is a perspective view of the cap/nozzle assembly in the secured position from a top and side thereof.
Figure 6F:
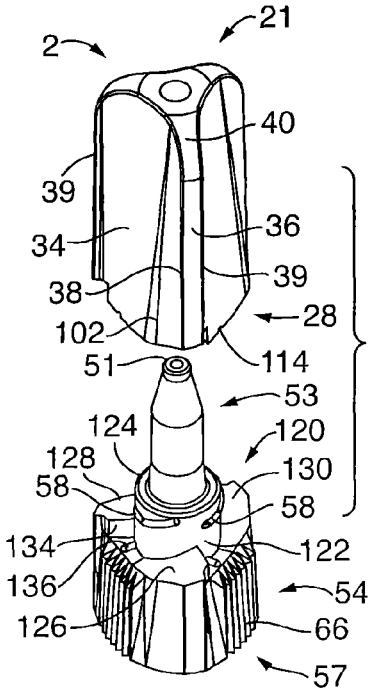
FIG. 6*f* shows an exploded side perspective view of the aligned cap/nozzle assembly.
Figure 6G:
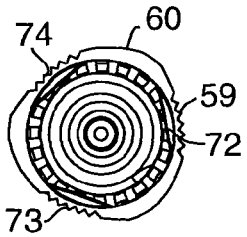
FIG. 6*g* is an underneath view of the cap/nozzle assembly.
Figure 6H:
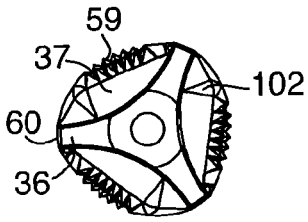
FIG. 6*h* is a top plan view of the cap/nozzle assembly.
Figure 6I:
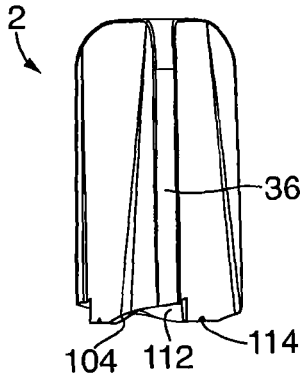
FIG. 6*i* is a side elevational view of the cap of FIG. 6.
Figure 6J:
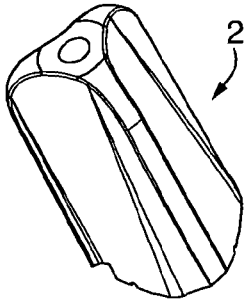
FIG. 6*j* is a perspective view of the cap of FIG. 6.
Figure 6L:
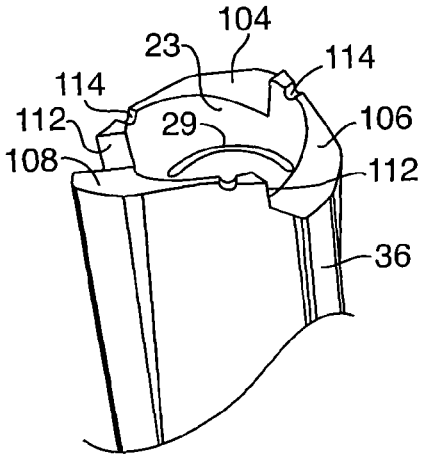
FIG. 6*l* is an enlarged partial perspective view of the bottom of the cap of FIG. 6.
Figure 6K:
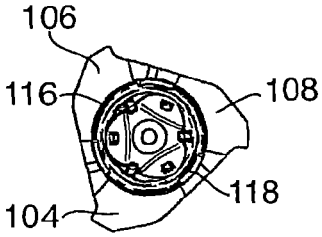
FIG. 6*k* is a bottom plan view of the cap of FIG. 6.
Figure 6M:
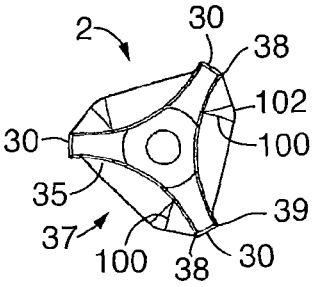
FIG. 6*m* is a top plan view of the cap of FIG. 6.
Figure 6N:
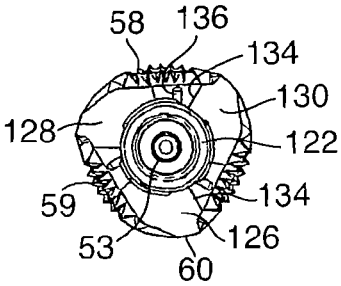
FIG. 6*n* is a top plan view of the nozzle of FIG. 6.

Another embodiment of a cap and nozzle assembly similar to those previously described is shown in FIGS. 6*a-n* so that the differences will be described for brevity. The cap 2 has three equiangularly disposed wings 30 each terminating in an outer terminal face 36 defined by adjacent wing borders 38, 39. Each wing 30 is contiguous with the next so that an exterior trailing face 34 of one wing portion together with an exterior leading face 35 of an adjacent wing portion 30 form one continuous somewhat concave surface 37 extending between the terminal faces 36 of the adjacent wings. As shown best in FIGS. 6*e*, 6*f*, a portion 100 of the trailing face 34 adjacent the cap base end 28 and wing trailing edge 38 is raised. The raised portion 100 extends for a portion of the wing 30 length. Advantageously, the raised portion 100 is somewhat triangularly shaped with a wider base 102 adjacent the cap base end 28 and extending toward the cap closed end 21, desirable terminating before the wing top corner 40. The raised portion 100 provides the adjacent wing 30 with a helical look and effect even when the wing edges 38, 39 are generally parallel.

With reference to FIGS. 61 and 6*l*, the cap base end 28 ends in three inclined surfaces 104, 106, 108. Advantageously, each inclined surface partly spirals from a raised condition under the adjacent wing terminal face 36 and angularly declines toward the other adjacent leading edge 39 until terminated at a shoulder 112 proximate the adjacent wing leading face 39. One or more of the inclined surfaces may define a detent 114 therein, which may be adjacent the shoulder 112.

The cap inside surface 23 defines a cavity within the cap extending from a generally circular opening 116 at the cap base end 28 toward the cap closed end 21. The opening 116 is surrounded by inclined surfaces 104, 106, 108. Engaging formations 29 project from the inside surface 23 for inter-engagement with cooperating engaging formations 58 on the nozzle to help removably secure the cap to the nozzle. Advantageously, the engaging formations 29 are interrupted screw threads. The inside surface 23 may define a step 118 or other portion between the engaging formations and the cap closed end.

With reference to FIG. 6*f*, the nozzle 3 comprises a base portion 54 having an intake end 57 and an opposing shoulder portion 120. The base portion is advantageously trilobal to match the profile of the cap base end 28. A plurality of parallel, longitudinally arranged ribs 66 may optionally project outwardly from some or all of the base portion 54 exterior to aid in gripping the nozzle.

A retaining section 122 extends axially from the shoulder portion 120 and terminates at a face 124. The retaining section 122 has a smaller diameter than the diameter defined by the trilobal base portion 54. The nozzle upper portion 53 extends axially from the face 124 to the dispensing end 51. The nozzle upper portion 53 has a smaller diameter than the retaining section 122. The internal conduit 56 fluidly extends from the intake end 57 to the dispensing end 51.

The shoulder portion comprises three inclined surfaces 126, 128, 130. Advantageously each inclined surface partly spirals around the retaining section 122. Each inclined surface terminates at a shoulder 134. A catch 136, which may be adjacent the shoulder 134, projects axially from one or more of the inclined surfaces.

Engaging formations 58 project from the surface of the retaining section 122 for inter-engagement with cooperating engaging formations 29 on the cap to help removably secure the cap to the nozzle. Advantageously, the engaging formations 58 are interrupted screw threads.

The cap 2 is overfitted and inter-engaged with the nozzle 3 to form the cap/nozzle assembly 1. This operation comprises longitudinally inserting the nozzle upper portion 53 and retaining section 122 through mouth 27 and into the housing 25. During insertion the cap and nozzle are subjected to relative rotation so that the respective screw threads 29 and 58 inter-engage. As relative rotation continues inter-engagement of the screw threads 29, 58 moves the cap base end 28 axially closer to the nozzle shoulder 55 so that inclined surfaces 104, 106, 108 on the cap come into engagement with adjacent inclined surfaces 126, 128, 130 on the nozzle.

As rotation of the cap and nozzle continues to the closed or secured position shown in FIGS. 6*a*-6*d* and 6*e*, the nozzle catch 136 resiliently biases into the cap detent 114 and the cap shoulder 112 contacts the nozzle shoulder 134. The shoulder 112 to shoulder 134 contact prevents further cap rotation in one direction, the catch 136 biased into the detent 114 selectively prevents cap rotation in the other direction and the inter-engaged threads 29, 58 prevent axial cap movement, thereby removably securing the cap to the nozzle.

The cap can be removed by rotating the cap in the opposite direction with a force sufficient to overcome the catch 136 bias in the detent 114. During removal the inclined surfaces of the nozzle 126, 128, 130 inter-engage or cam against the inclined surfaces of the cap 104, 106, 108 during rotation to exert an axial force on the cap. This axial force is greater than provided by inter-engagement of the screw threads 29, 58 alone and is desirable to overcome any bonding between the cap and nozzle resulting from prior dispensing of an adhesive.

As shown in FIGS. 6*a*-6*d* and 6*e* the cap and nozzle in the secured position has a continuous profile, that is the profile of the cap matches and flows relatively smoothly into the profile of the nozzle. The profile contributes to the skewed or part-helical profile of the cap and the overall assembly.

In desirable variations, the intermediate portions 60 of the base portion 54 and the outer faces 36 of the wing portions 30 are aligned in the closed position as are the concave surfaces 37 of the cap and the depressions 59 of the nozzle. The cap 2, and in particular the wing portions 30 thereof fall substantially within the footprint of the nozzle base 54. A plurality of parallel, longitudinally arranged ribs 66 project outwardly from each body depression 59. These variations reinforce twisted or skewed appearance (in an anti-clockwise direction) of the cap and nozzle assembly.

Figure 8:
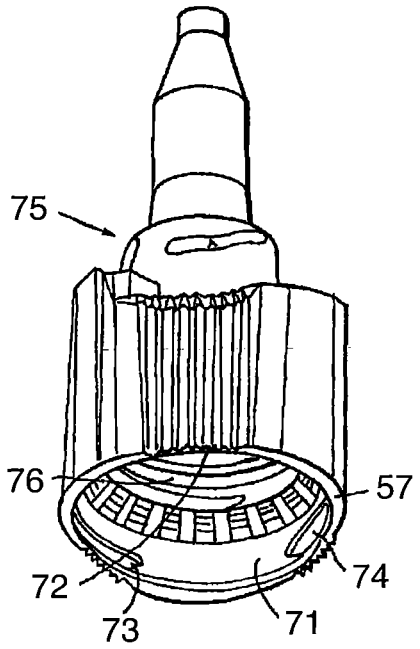
FIG. 8 shows an underneath view of the dispensing nozzle shown within FIG. 7.
Figure 9:
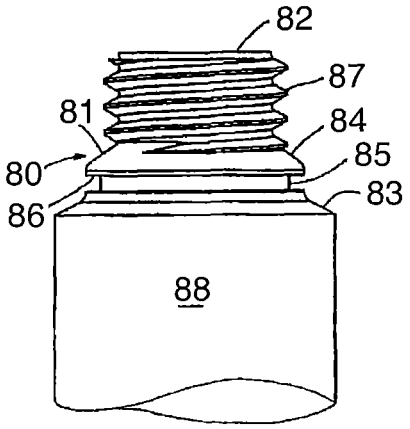
FIG. 9 shows an enlarged partial side elevational view of the tube shown within FIG. 7.

FIG. 8 shows an embodiment of a nozzle 75 with an intake end 57 provided with engaging means. The engaging formations shown in FIG. 8 are three evenly spaced projections or grips 72, 73, 74 located on the underside 71 of the nozzle. However it should be appreciated that any number of projections may be used. The grips lock the nozzle to a container, for example holding a curable product.

Figure 7:
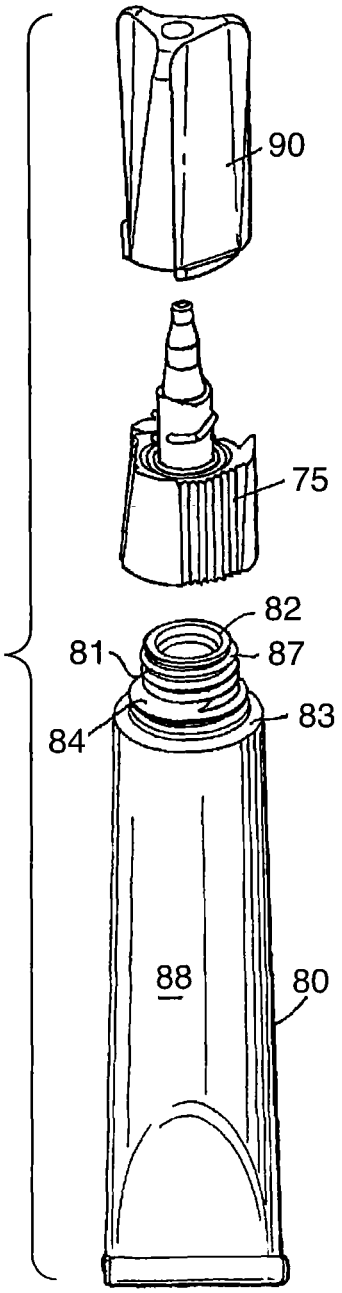
FIG. 7 is an exploded view of a further aspect which is a permanent locking arrangement, for permanently locking a nozzle to a tube, and in particular comprising a tube, a dispensing nozzle for the tube and a cap.

A container on which the nozzle of FIG. 8 may be mounted is shown in FIGS. 7 and 9-11. FIG. 7 shows an aluminum tube 80 with an open-ended tube nozzle 82 mounted on a tube reservoir 88 and through which the contents of the tube can be dispensed. (This part of the tube 80 may be best seen in the enlarged view of FIG. 9.) The open nozzle 82 connects with the aluminum tube along neck portion 83. Screw threads 87 are provided on the tube 80 about the nozzle 82. The entire tube 80 including open nozzle 82 is usually formed of aluminum. Towards the base of the nozzle 82 a locking ring 81 is provided. The ring 81 is provided between the screw threads 87 and the tube reservoir 88. The locking ring is a projecting ring that runs around the tube nozzle 82.

Figure 10:
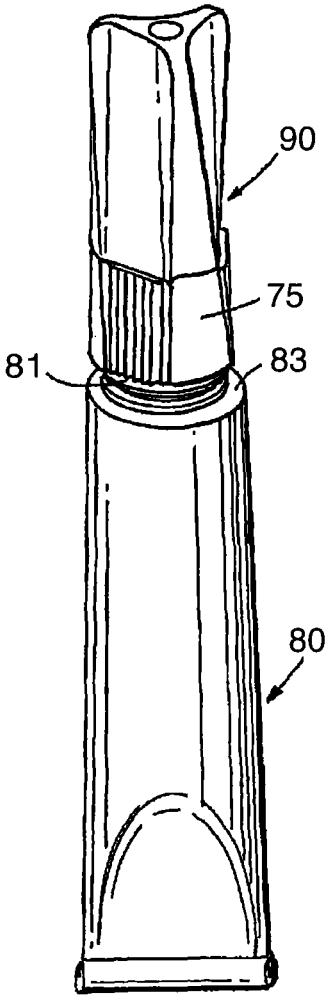
FIG. 10 shows the assembled configuration of the device shown in FIG. 7 (the dispensing nozzle is in place on the tube but not locked on the tube and the cap is over-fitted on the dispensing nozzle).
Figure 11:
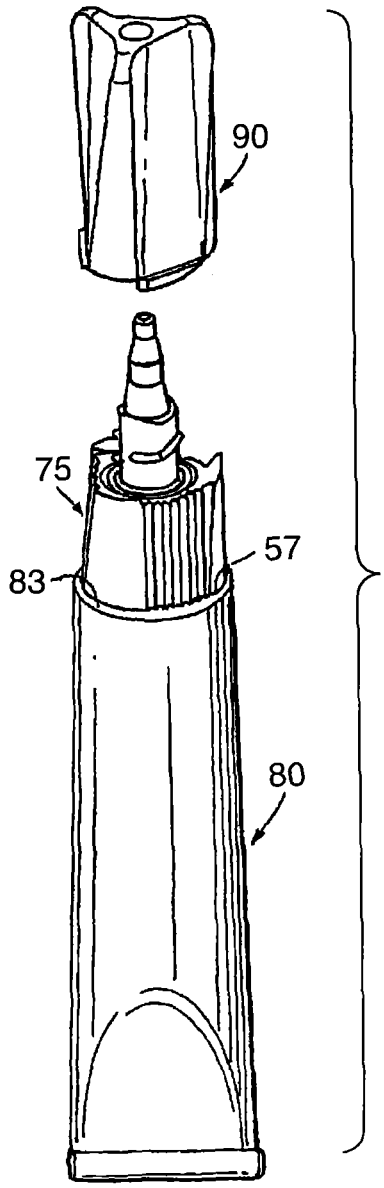
FIG. 11 shows the assembled configuration of the device shown in FIG. 7 (the dispensing nozzle is in place on the tube and is locked on the tube and the cap is removed from the dispensing nozzle for dispensing).

The ring is arranged for interengaging with the grips 72-74 on the dispensing nozzle 75. The grips 72-74 on the underside 71 of the nozzle 75 fit over the locking ring 81 to permanently lock the nozzle 75 to the tube 80 in the assembled configuration of FIG. 11. In one embodiment, the tube, dispensing nozzle and cap are assembled as shown in FIG. 10. In this arrangement, which may for example be an arrangement prior to first use, the nozzle 75 is not fully fitted on the tube 80. In particular the dispensing nozzle is not yet locked in place on the tube (as can be seen in FIG. 10 the locking ring 81 is still visible), but is fitted to the tube for display or sale. Initially a user screws the dispensing nozzle 75 into the locked position moving the grips 72-74 over the locking ring 81 (as shown in FIG. 11). Such action may also cause a piercing skirt on the underside of the nozzle to puncture a protective membrane closing the nozzle 82 of the tube 80. Thereafter the contents of the tube 80 can be dispensed through dispensing nozzle 75. As also shown in FIG. 11 the cap 90 can be removed leaving the dispensing nozzle 75 in place.

An upper surface 84 of the locking ring (see FIG. 9) has a tapered profile that will facilitate the movement of the grips 72-74 on the nozzle over the locking ring. As the grips 72-74 travel across the tapered surface 84 of the locking ring they and/or the ring will resiliently deform until they pass over the ring 81. When they have passed over the ring they become seated within an annular channel 85 behind the locking ring. In particular the grips 72-74 engage an under-surface 86 of the locking ring 84 the profile of which restricts the movement of the grips back over the locking ring thereby permanently securing the nozzle to the tube.

In the embodiment, and as described above, the tube nozzle 82 has screw threads 87 which allow the dispensing nozzle 75 to be screwed onto the tube before locking. The engagement of the dispensing nozzle 75 onto tube 80 is achieve by screwing the parts together using the reciprocal screw threads 76 and 87 (on the dispensing nozzle and on the tube respectively). When the two parts are mated in this way to a sufficient extent the grips 72-74 engage with the locking ring thus locking the dispensing nozzle in place on the tube 80 as shown in FIG. 11. The locking is sufficient to ensure that the nozzle does not come off inadvertently during use, for example due to manual twisting to remove a cap. Substantially greater force than normal manual pressure is required to remove the nozzle and a user would have to resort to more extreme measures to forcibly remove the nozzle from the tube.

A cap 90 is provided which overfits the dispensing nozzle 75. In particular the cap 90 screws onto the nozzle 75 to form the cap/dispensing nozzle/tube assembly of FIG. 7. The nozzle 75 and cap 90 can be similar in construction to the nozzle and cap of previous embodiments and are not described in detail herein.

It will be appreciated that the nozzle/cap profile is continuous in the assembled arrangement (shown in FIG. 2) of the cap and nozzle and contributes to the skewed or part-helical profile of the cap and indeed the overall assembly.

As best seen from FIG. 2 when the cap 2 is overfitted and interengaged with the nozzle 3 it forms the assembly 1. In particular, the upper portion 53 of the nozzle 3 is inserted into the cap body 4, and in particular the housing 25 thereof by insertion through mouth 27 of the cap 2. The cap and nozzle have been subjected to relative rotation so that the cap and nozzle are held together by interengagement of their respective screw threads 29 and 58. The cap is fully on the nozzle and the profiles of each part mate or come into register with each other as shown in FIG. 2.

Figure 2A:
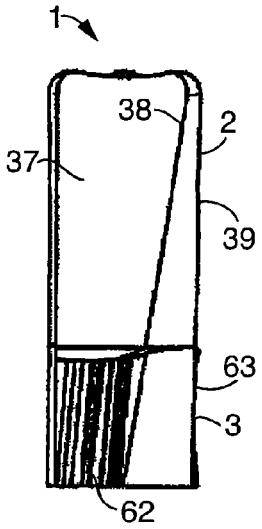
FIG. 2*a* is a front elevational view thereof.
Figure 2B:
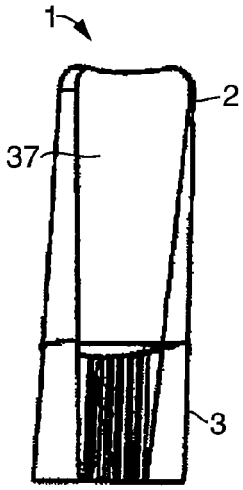
FIG. 2*b* is a side elevational view thereof.
Figure 2C:
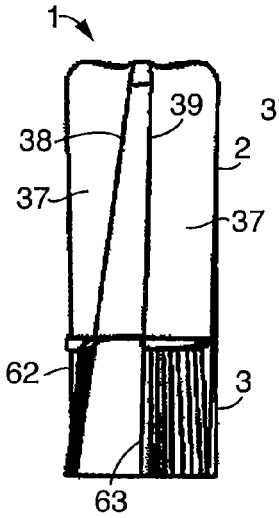
FIG. 2*c* is a rear elevational view thereof.
Figure 2D:
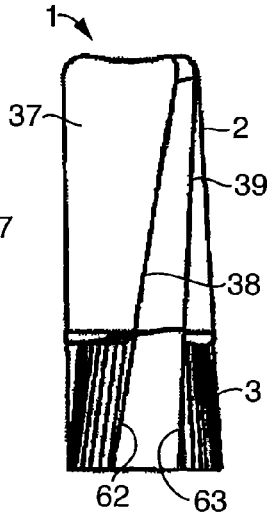
FIG. 2*d* is a side elevational view thereof from the other side thereof.
Figure 2E:
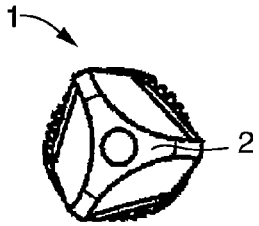
FIG. 2*e* is a top plan view thereof.
Figure 2F:
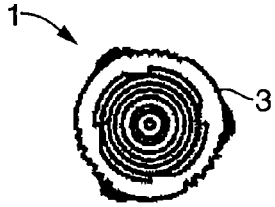
FIG. 2*f* is an underneath view thereof.
Figure 2G:
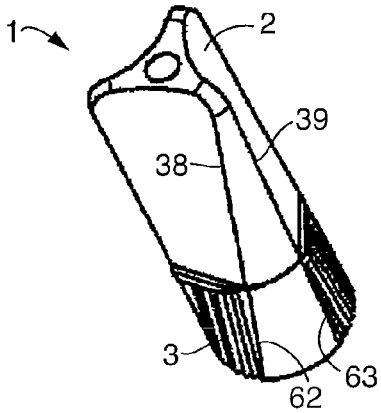
FIG. 2*g* is a perspective view thereof from a top and side thereof.
Figure 4A:
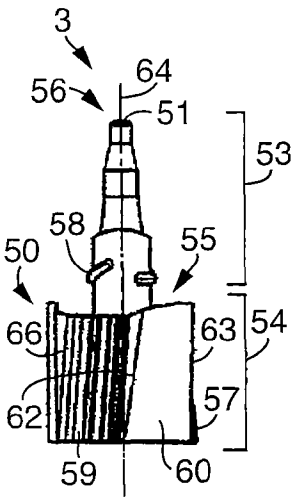
FIG. 4*a* is a front elevational view thereof.
Figure 4B:
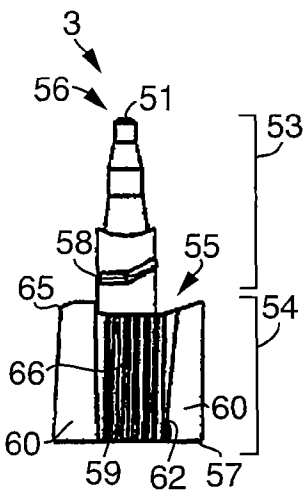
FIG. 4*b* is a side elevational view thereof.
Figure 4C:
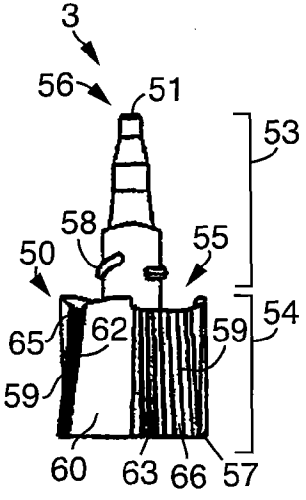
FIG. 4*c* is a rear elevational view thereof.
Figure 4D:
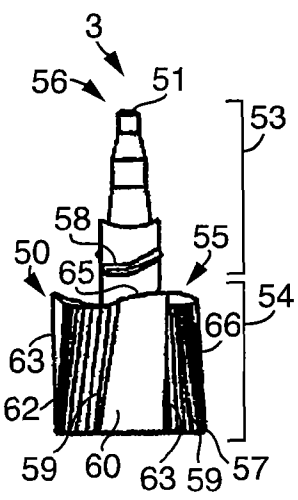
FIG. 4*d* is a side elevational view thereof from the other side thereof.
Figure 4E:
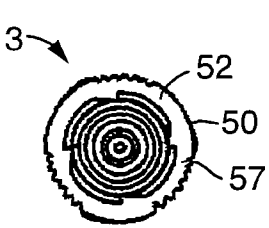
FIG. 4*e* is a top plan view thereof.
Figure 4F:
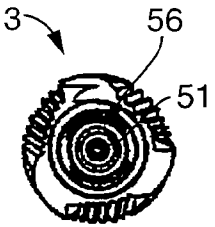
FIG. 4*f* is an underneath view thereof.
Figure 4G:
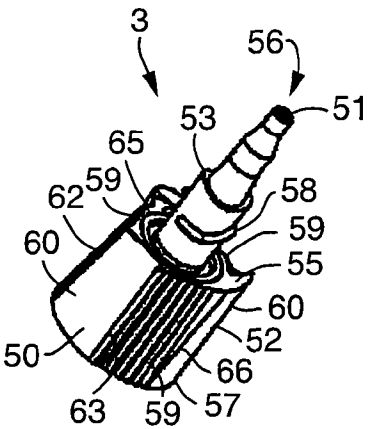
FIG. 4*g* is a perspective view thereof from a top and side thereof.
Figure 5A:
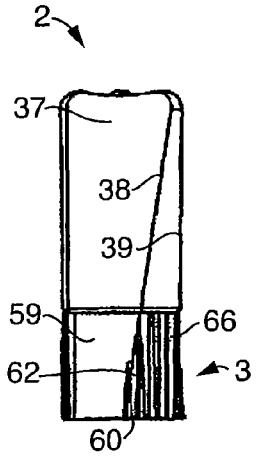
FIG. 5*a* is a front elevational view thereof.
Figure 5B:
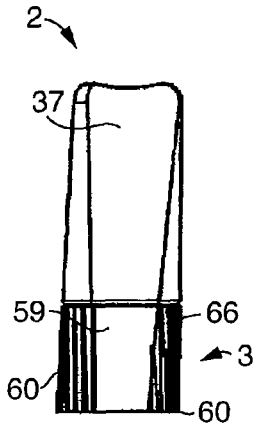
FIG. 5*b* is a side elevational view thereof.
Figure 5C:
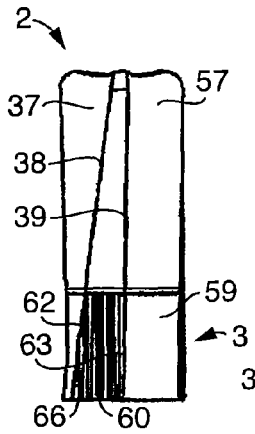
FIG. 5*c* is a rear elevational view thereof.
Figure 5D:
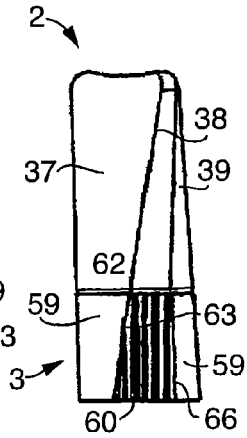
FIG. 5*d* is a side elevational view thereof from the other side thereof.
Figure 5E:
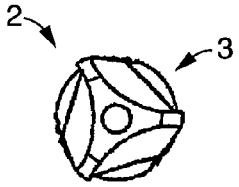
FIG. 5*e* is a top plan view thereof.
Figure 5F:
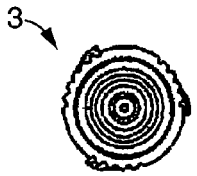
FIG. 5*f* is an underneath view thereof.
Figure 5G:
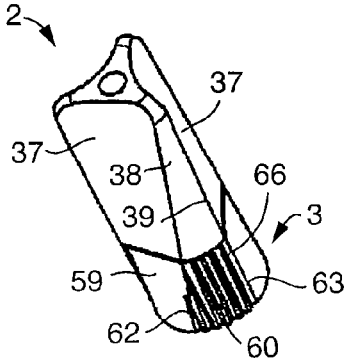
FIG. 5*g* is a perspective view thereof from a top and side thereof.

As can be seen from FIGS. 2*a-g* the intermediate portions 60 of the base portion 54 of the nozzle and the outer faces 36 of the wing portions 30 are aligned as are too the concave surfaces 37 of the cap and the depressions 59 of the nozzle. The overall profile, seen in perspective in FIG. 2*g* gives the cap nozzle arrangement a twister or skewed appearance (in an anti-clockwise direction). The cap 2, and in particular the wing portions 30 thereof fall substantially within the footprint of the nozzle cap arrangement. The ribs 66 run parallel to a longitudinal axis of the nozzle.

FIGS. 5*a-g* shows an alternative embodiment where the ribs 66 are provided on each of intermediate portions 60. No ribs are provided in the depressions 59. In this embodiment it can be seen that the depressions 59 have a concavity which matches that of the concave surfaces 37 of the cap 2. The ribs 66 are truncated whenever they meet a boundary of the intermediate portion 60, for example where they meet edge 62.

The matching profile at the cap and nozzle provides a visual reference which allows a user to easily determine how the cap and nozzle align and also determine what action needs to be taken to remove the cap from the nozzle. In the embodiment shown a twist action is provided but the cap and nozzle may be interengaged in any suitable way for example by snap-fitting.

In the embodiments shown when relative rotation of the cap and the nozzle take place, in a direction for removal of the cap from the nozzle, the lips 42 on the cap ride across the inclined surfaces on the shoulder 55 of the nozzle and thus create a strong removal force for removing the cap from the nozzle in the event they are bonded to each other.

The embodiment shown is particularly useful on a typical hand held adhesive dispenser; using three wing portions provides the optimal ergonomic arrangement for a user's fingers to engage with the wing portions. A greater number of wing portions may be used on embodiments of the invention employing larger sized caps. In some embodiments, the number of wing portions can be determined in part by a preference that the concave surface 37 substantially accommodates the width of a human finger or thumb.

The curable products to be held within the container include adhesives, sealants and coatings. Suitable curable products include cyanoacrylate adhesives.

Suitable cyanoacrylate adhesives are those which are based upon cyanoacrylate monomers such as alkyl, alkenyl and alkoxy cyanoacrylate esters, more particularly such esters wherein the alkyl or alkenyl group has up to 10 carbon atoms, especially up to 5 carbon atoms. The cyanoacrylate monomer (s) may be selected from methyl, ethyl, n-propyl, iso-propyl, n-butyl, iso-butyl, sec-butyl, tert-butyl, n-pentyl, iso-pentyl, n-hexyl, iso-hexyl, n-heptyl, iso-heptyl, n-octyl, n-nonyl, allyl, methoxyethyl, ethoxyethyl, 3-methoxybutyl and methoxyisopropyl cyanoacrylate esters.

Other curable products include those adhesives which are based upon polymerizable acrylate ester monomers. The monomers utilised may be monofunctional or a combination of mono- and polyfunctional monomers. Generally, the monomers are exemplified but not limited to those selected from the class consisting of alkyl acrylates, cycloalkyl acrylates, alkyl methacrylates, cycloalkyl methacrylates, alkoxy acrylates, alkoxy methacrylates, alkylene diacrylates and alkylene dimethacrylates. Also included are products based upon monofunctional monomers such as methyl methacrylate, lauryl methacrylate, 2-ethyl hexyl methacrylate, ethyl methacrylate, n-butyl methacrylate, iso-butyl methacrylate and t-butyl methacrylate. Other suitable products include those based upon tetrahydrofurfuryl methacrylate, cyclohexyl methacrylate, isobornyl methacrylate, hydroxyethyl methacrylate and hydroxypropyl methacrylate.

The monofunctional monomers mentioned above may generally be represented by the formula:

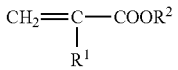

where $R^1$ is H, $CH_3$ or $C_1$-$C_6$ alkyl, $R_2$ is H, $C_1$-$C_{20}$ alkyl, $C_1$-$C_{20}$ alkoxy, $C_3$-$C_{20}$ cycloalkyl, or $C_2$-$C_{20}$ alkylene group.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

What is claimed is:

1. A cap and elongated nozzle assembly, comprising:

the elongated nozzle having a longitudinal axis and comprising:

a base portion with an intake end and an opposed shoulder portion;

an upper portion extending axially from the shoulder portion to a distal dispensing end, the upper portion having a reduced cross section relative to the base portion;

an internal conduit running from the intake end to the dispensing end, for delivering product from the intake end to the dispensing end;

engaging formations provided on the upper portion capable of inter-engaging with co-operating engaging formations on the cap to removably hold the cap in the closed position on the nozzle;

the cap having an elongate cap body with a longitudinal axis, an outside surface and an inside surface, the cap body comprising:

a first closed end longitudinally spaced from a second open end, the second end defining a mouth and connected to the inside surface;

at least one sidewall integrally formed with and depending from the closed end to define a housing, the housing for receiving and overfitting at least a part of the nozzle upper portion;

engaging formations provided on the inside surface capable of inter-engaging with co-operating engaging formations on the nozzle to removably hold the cap in the closed position on the nozzle;

a plurality of elongate, angularly spaced apart wing portions, each wing portion having an inner part proximate the longitudinal axis of the cap, an outer part radially spaced therefrom, and two exterior opposing faces, each exterior face forming part of the outside surface of the cap, each wing portion exterior face contiguous with the next wing portion exterior face so that an exterior face of one wing portion together with an exterior face of an adjacent wing portion form one continuous surface between adjacent wing portions, the wing portions defining a diameter around the cap longitudinal axis that is substantially the same adjacent the first and second ends;

wherein each wing portion includes a raised portion adjacent one outer part of each wing extending for a portion of the wing portion, said raised portion having a triangular shape with a wider base adjacent said open end and a narrower extent adjacent said closed end so as to provide a helical look and effect for visual indication to a user of the direction of twisting for removal of the cap.

2. A cap and elongated nozzle assembly according to claim 1 wherein the cap consists of three, equiangularly spaced wing portions.

3. A cap and elongated nozzle assembly according to claim 1 wherein the cap continuous surface between adjacent wing portions is generally concave.

4. A cap and elongated nozzle assembly according to claim 1 wherein the cap inside surface engaging formations comprise a plurality of interrupted screw threads.

5. A cap and elongated nozzle assembly according to claim 1 wherein the cap open end is substantially circular.

6. A cap and elongated nozzle assembly according to claim 1 wherein each cap wing portion outer part comprises two, spaced edges defining a wing outer terminal face.

7. A cap and elongated nozzle assembly according to claim 1 wherein the nozzle base portion includes at least three depressions, each depression disposed between two intermediate portions each of which stand proud of the depressions, the depressions being arranged to come into register with the continuous surfaces of the cap when the cap is in a closed position on the nozzle.

8. A cap and elongated nozzle assembly according to claim 1 wherein the nozzle base portion is trilobal or generally circular.

9. A cap and elongated nozzle assembly according to claim 1 wherein the nozzle base portion includes at least three depressions and at least three intermediate portions, each depression disposed between two intermediate portions each of which stand proud of the depressions, the depressions being arranged to come into register with the continuous surfaces of the cap when the cap is in a closed position on the nozzle, wherein each intermediate portion has an outer face which is defined between edges of that face.

10. A cap and elongated nozzle assembly according to claim 1 wherein the nozzle comprises a plurality of inclined surfaces adjacent the shoulder portion, each inclined surface terminating in a shoulder.

11. A cap and elongated nozzle assembly according to claim 1 wherein the nozzle base portion includes at least three generally concave depressions.

12. A cap and elongated nozzle assembly according to claim 1 wherein the nozzle base portion comprises a plurality of parallel, longitudinally extending ribs projecting outwardly therefrom.

13. A container comprising a container body for holding dispensable product and an assembly according to claim 1 arranged thereon as a closure for the container.

14. A container comprising a container body for holding dispensable product and an assembly according to claim 1 arranged thereon as a closure for the container, wherein the nozzle is integrally formed with the container.

15. A container comprising a container body, a curable product held within the container body and an assembly according to claim 1 arranged thereon as a closure for the container.

16. A container comprising a container body, a cyanoacrylate-based product held within the container body and an assembly according to claim 1 arranged thereon as a closure for the container.

17. A cap and elongated nozzle assembly according to claim 1 wherein the nozzle comprises a plurality of inclined surfaces adjacent the shoulder portion, at least one inclined surface includes one of a catch or a detent;

the cap open end comprises a plurality of inclined surfaces, at least one cap inclined surface includes the other of the catch or the detent, wherein the catch is resiliently biased into the detent when the cap is in the closed position on the nozzle to prevent cap rotation around the nozzle.

18. A cap and elongated nozzle assembly according to claim 1 wherein the nozzle comprises a plurality of inclined surfaces adjacent the shoulder portion, at least one nozzle inclined surface includes a nozzle abutment;

the cap open end including a plurality of inclined surfaces complementary to the nozzle, at least one cap inclined surface includes a cap abutment;

wherein the nozzle abutment contacts the cap abutment when the cap is in the closed position on the nozzle to prevent cap rotation in one direction.

19. A cap and elongated nozzle assembly, comprising:

the elongated nozzle having a longitudinal axis and comprising:

a base portion with an intake end and an opposed shoulder portion;

an upper portion extending axially from the shoulder portion to a distal dispensing end, the upper portion having a reduced cross section relative to the base portion;

an internal conduit running from the intake end to the dispensing end, for delivering product from the intake end to the dispensing end;

engaging formations provided on the upper portion capable of inter-engaging with co-operating engaging formations on the cap to removably hold the cap in the closed position on the nozzle;

a plurality of nozzle axial inclined surfaces adjacent the shoulder portion, at least one nozzle axial inclined surface includes a nozzle abutment and at least one nozzle axial inclined surface includes one of a catch or a detent;

the cap having an elongate cap body with a longitudinal axis, an outside surface and an inside surface, the cap body comprising:

a first closed end longitudinally spaced from a second open end, the second end defining a mouth and connected to the inside surface;

the cap open end including a plurality of inclined surfaces complementary to the nozzle, at least one cap inclined surface includes a cap abutment and at least one cap inclined surface includes the other of the catch or the detent, at least one sidewall integrally formed with and depending from the closed end to define a housing, the housing for receiving and overfitting at least a part of the nozzle upper portion;

engaging formations provided on the inside surface capable of inter-engaging with co-operating engaging formations on the nozzle to removably hold the cap in the closed position on the nozzle;

a plurality of elongate, angularly spaced apart wing portions, each wing portion having an inner part proximate the longitudinal axis of the cap, an outer part radially spaced therefrom, and two exterior opposing faces, each exterior face forming part of the outside surface of the cap, each wing portion exterior face contiguous with the next wing portion exterior face so that an exterior face of one wing portion together with an exterior face of an adjacent wing portion form one continuous surface between adjacent wing portions, wherein each wing portion includes a raised portion adjacent one outer part of each wing extending for a portion of the wing portion, said raised portion having a triangular shape with a wider base adjacent said open end and a narrower extent adjacent said closed end so as to provide a helical look and effect;

wherein the nozzle abutment contacts the cap abutment when the cap is in the closed position on the nozzle to prevent cap rotation around the nozzle in one direction and the catch is biased into the detent when the cap is in the closed position on the nozzle to prevent cap rotation around the nozzle in the other direction.

* * * * *